US005116275A

United States Patent [19]

Sassak

[11] Patent Number: 5,116,275

[45] Date of Patent: * May 26, 1992

[54] TOSSABLE FLYING DISC

[76] Inventor: Mark S. Sassak, 1340 Linden, Plymouth, Mich. 48170

[ * ] Notice: The portion of the term of this patent subsequent to Nov. 27, 2007 has been disclaimed.

[21] Appl. No.: 617,605

[22] Filed: Nov. 26, 1990

Related U.S. Application Data

[63] Continuation-in-part of Ser. No. 440,810, Nov. 24, 1989, Pat. No. 4,973,284.

[51] Int. Cl.[5] ..... A63H 27/00; A47F 7/00

[52] U.S. Cl. ..... 446/48; 446/77; 248/315; 248/102; 220/732

[58] Field of Search ..... 446/48, 46, 266, 240, 446/71, 77; 273/425, 424; 220/703, 731, 732, 737; 215/11.1; 248/315, 102, 105

[56] References Cited

U.S. PATENT DOCUMENTS

| | | | |
|---|---|---|---|
| 2,033,296 | 3/1936 | Porter | 248/102 |
| 2,956,369 | 10/1960 | Rolin | 446/266 |
| 3,575,414 | 4/1971 | O'Brien | 446/236 X |
| 3,859,748 | 1/1975 | Blue | 446/236 |
| 4,820,230 | 4/1989 | Richards | 446/48 |
| 4,854,907 | 8/1989 | Holmes | 446/48 |
| 4,984,697 | 1/1991 | Kelly | 248/102 X |

FOREIGN PATENT DOCUMENTS

| | | | |
|---|---|---|---|
| 416687 | 9/1934 | United Kingdom | 273/425 |

OTHER PUBLICATIONS

"Spin-Twin", Kilgore, Playthings magazine, p. 125, Apr. 1959.

"Disco-Go", Foamcraft Specialties, Inc., East Paterson, N.J., Mar. 1966.

*Primary Examiner*—Mickey Yu

*Attorney, Agent, or Firm*—Harness, Dickey & Pierce

[57] ABSTRACT

A soft, lightweight disc is capable of being used as a tossing toy or twirled around a finger. The disc is circular with an inner perimeter and an outer perimeter and contains a hole centrally in its body. The disc can be constructed of soft buoyant material to enhance floating. For amusement, a doll, or a soda can, and the like could be secured in the central hole. The doll is spherical and fits securely inside the inner perimeter of the disc. An annular disc can be used to rigidify the lower surface of the tossing toy and enhance air flotation and lift. A pair of like annular discs can be used to form a tossing toy.

11 Claims, 3 Drawing Sheets

TOSSABLE FLYING DISC

This invention is a continuation-in-part of application Ser. No. 07/440,810, filed Nov. 24, 1989, and issued Nov. 27, 1990 as U.S. Pat. No. 4,973,284.

BACKGROUND AND SUMMARY OF THE INVENTION

The present invention relates generally to tossable circular flying disc toys, and more particularly to an improved circular flying disc which is soft and flexible and which is adapted to receive an object, such as a soft spherical-shaped doll or soda can, inserted into its center. The tossable discs have a distinctive appearance and enhanced flight path when thrown.

Flying disc toys have gained recognition in the field of amusement devices. Typical of these flying disc toys is the "Frisbee", which is a closed-figure flying disc made of a relatively rigid material, such as plastic, having a recessed undersurface so that when tossed into the air, the disc will fly in a rotating fashion. This disc is not suitable to indoor use or capable of receiving an insertable element in its center.

Flying disc toys have been discovered that were formed from a flexible material and capable of indoor use. However, these discs are all of a closed-figure construction and are thus not capable of receiving an insertable element in their center.

Flying disc toys have also been discovered that have an opening in their center. However, these discs are formed of a relatively rigid material, and these discs are not suitable for indoor use nor are they particularly adaptable for receiving an insertable element in the center.

It is an object of the present invention to provide a soft, flexible, lightweight flying disc capable of receiving a soft spherical-shaped doll in its center which can be thrown, containing the doll, and which will provide the invention with a distinctive and appealing appearance.

It is a further object of this invention to provide a flying disc and doll combination which is made of soft, flexible, lightweight material and is safe for use indoors and can be used by small children in complete safety.

It is a further object of this invention to provide a flying disc and doll combination where the doll will easily fit inside the center of the disc and will stay secure inside the disc when the disc is thrown.

It is a further object of this invention to provide a disc and doll combination that can be twirled around on a finger as well as thrown.

It is a further object of this invention to provide a flying disc and doll combination which are easily separated and can be used separately as a flying disc and a doll.

The flying disc of the present invention includes a body constructed of a soft, lightweight material. The body has an upper and a lower surface, a circular central opening, and a circular hole in the body, about the diameter of a finger, extending between the upper and lower surfaces.

In accordance with one embodiment of this invention, the upper and lower surfaces are covered with fabric which is sewn together at the inner perimeter, enclosing the central opening, and at the outer perimeter of the circular body. A soft, spherical-shaped doll constructed of a foam-like material is inserted into the central opening of the disc and is held in place by synthetic materials which adhere when pressed together such as the hook and loop friction material solid under the trademark Veloco. The flying disc secured inside the central opening of the disc, or the doll can be taken out of the disc and the two can be used separately.

In accordance with another embodiment of this invention, the upper and lower surfaces of the circular body form generally flat parallel planes.

In another embodiment, a rigid planar disc having a central opening is bonded to the lower surface of the soft foam body, the central openings being concentrically disposed with the diameter of the opening in the body being less than that of the rigid disc. The rigid disc cooperates to form a concave cavity at the central portion of the lower surface which enhances lift of the combination.

BRIEF DESCRIPTION OF THE DRAWINGS

Additional benefits and advantages of the present invention will become apparent by reference to the following drawings depicting a preferred embodiment of the invention.

DETAILED DESCRIPTION OF THE PREFERRED EMBODIMENT

Figure 3:
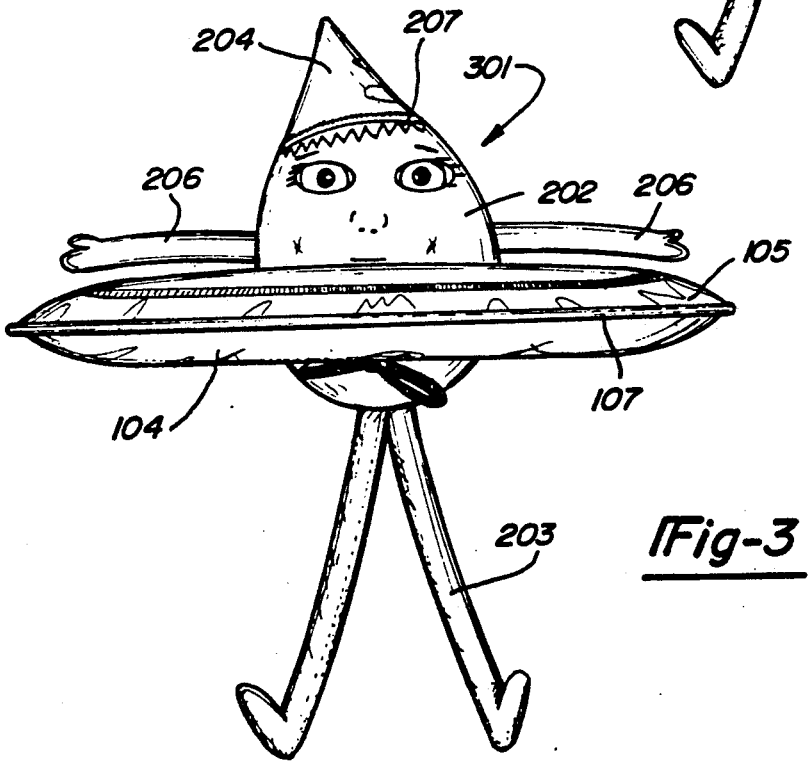
FIG. 3 is a perspective view of the inventive combination.

Referring now to the drawings, FIG. 3 depicts a typical combination flying disc and doll toy 301 comprised of a flying disc 101 made of a soft, lightweight material which has a circular central opening 102 and a spherical-shaped doll 201 made of a foam-like material which fits securely into the central opening 102 of the flying disc 101.

Figure 1:
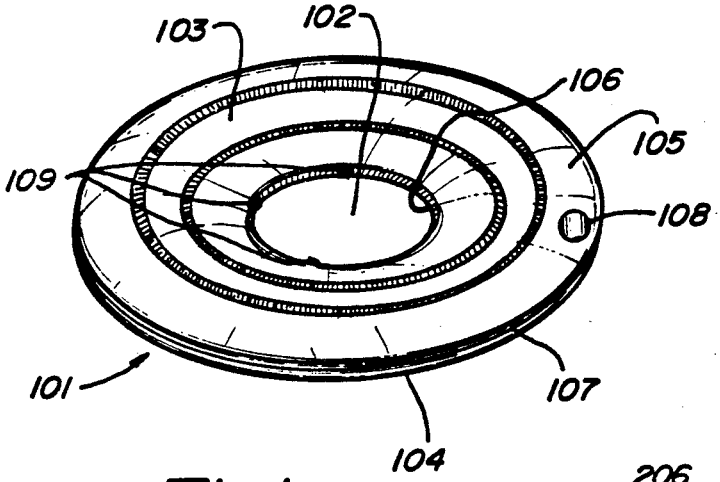
FIG. 1 is a top perspective view of the flying disc portion of the invention.

The flying disc portion 101 of the combination, as in FIG. 1, includes a circular body 105 having a circular central opening 102. The circular body 105 is constructed of a soft, lightweight material such as foam, fabric, or a fiber stuffing. The circular body has an upper surface 103 and a lower surface 104 which form an inner perimeter 106 which encloses the central opening 102 and an outer perimeter 107 which encloses the inner perimeter 106. The upper surface 103 and the lower surface 104 are curved from the inner perimeter 106 to the outer perimeter 107 and there is a hole 108 with a diameter of about three-fourths of an inch in the circular body 105 running from the upper surface 103 to the lower surface 104. Fabric or any other suitable material can then be placed over the body 105 of the disc and be contained with nylon tape. This fabric can then be sewn or stitched together at the inner perimeter 106 and outer perimeter 107 of the disc. A synthetic material which adheres when pressed together, such as the hook and loop fastener material sold under the trademark Velcro, can be placed on the inner perimeter 106 of the disc and can also be added to the doll 201 on the arms 206 to further aid in securing the doll 201 to the disc 101.

The finished disc has an inner perimeter 106 with a diameter of about three inches and an outer perometer 107 with a diameter of about nine inches. This disc is very soft and extremely light in weight, weighing approximately one ounce, and is especially safe for indoor use and use by children.

Figure 2:
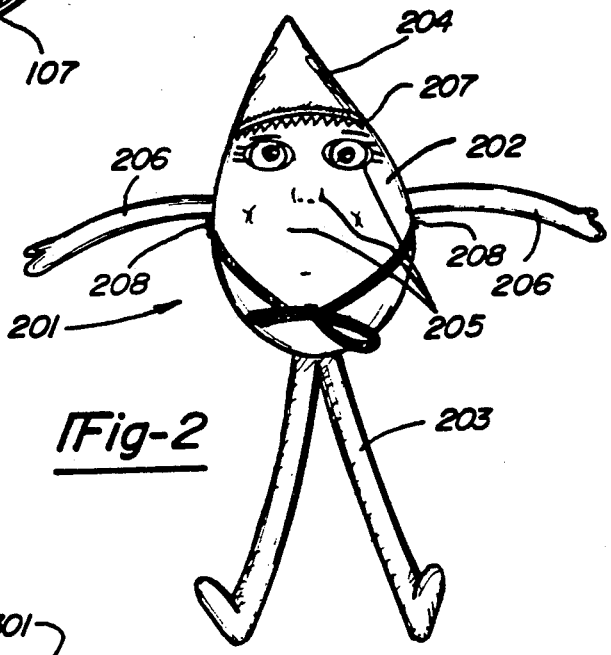
FIG. 2 is a perspective view of the doll portion of the invention.

The doll portion 201 of the combination, as shown in FIG. 2, includes a spherical body 202 made of a foam-like or fiber stuffing material. The doll 201 will fit securely into the circular central opening 102 of the flying disc 101 portion of the invention. This doll can have facial features 205 either drawn on the body 202 or attached to the body 202. The doll can also have legs 203 attached to the bottom of the body 202 which extend downward during the flight of the toy and arms 206 which extend outward during the flight of the toy. A synthetic material which adheres when pressed together, such as the hook and loop fastener material sold under the trademark Velcro, can be attached under the arms 206 to aid in securing the doll 201 inside the disc 101. The doll also has a hat 204 attached to the portion of the body 202 that will be extending upward during flight. Hair 207 made of a yarn-like material may also be attached under the hat 204.

The doll is soft and very light in weight, weighing only about two (2) ounces. Thus, the inventive combination 301 of the flying disc 101 and doll 201 is very soft and lightweight (weighing only about three ounces) and is very well suited for indoor use and for use by children.

Figure 4:
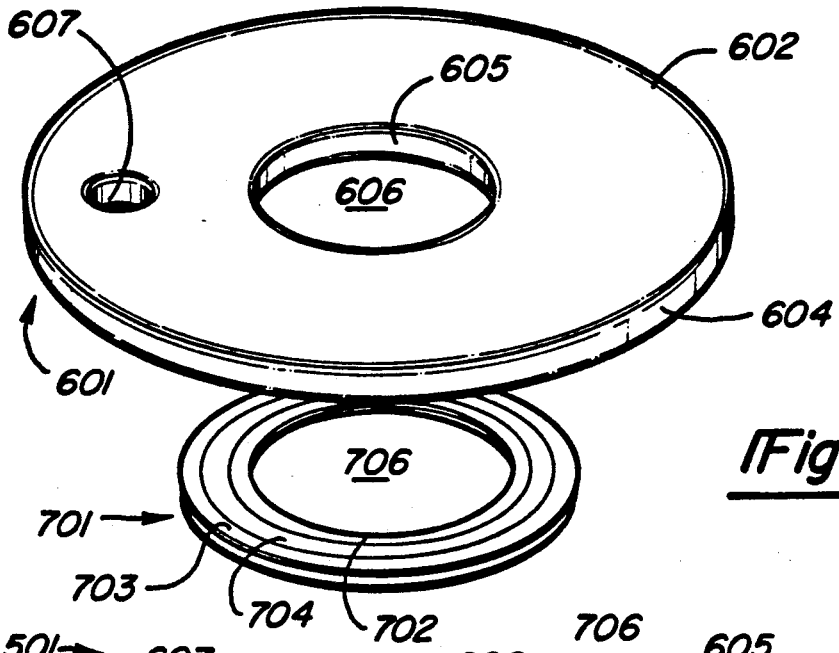
FIGS. 4 and 5 show, respectively, assembly of and another preferred embodiment in cross-section of a flying disc in accordance with this invention.
Figure 5:
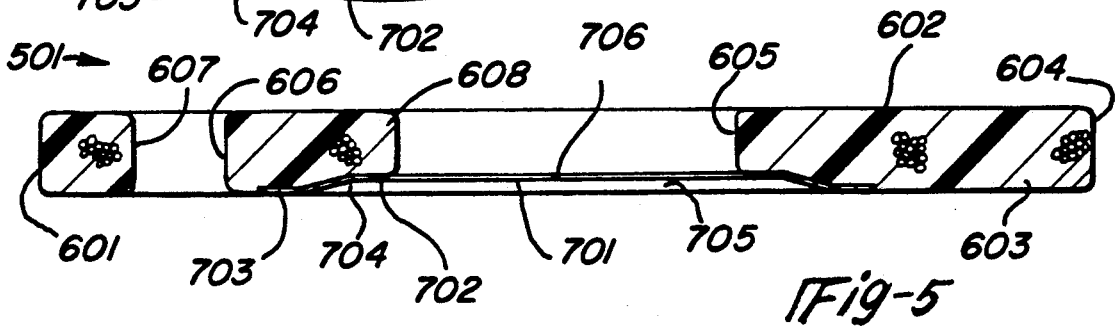

FIGS. 4 and 5 show another preferred embodiment of a tossable flying disc 501 in accordance with this invention. Disc 501 comprises a combination of a lightweight disc 601 constructed of foam to which is bonded a thin rigid generally planar disc 701 of plastic. Disc 601 includes planar upper and lower surfaces 602 and 603, and cylindrical outer and inner walls 604 and 605, the inner wall 605 defining a circular central opening 606. Upper and lower surfaces 602 and 603 define generally parallel planes and the cylindrical walls 604 and 605 are concentric with one another about a central axis and are disposed substantially orthogonally to the surfaces 602 and 603. Further, a circular hole 607 extends between the surfaces 602 and 603 whereby to define an opening to receive the index finger when twirling is desired.

Preferably and in accordance with this invention, disc 601 is constructed of a soft, lightweight, and buoyant foam. Additionally, a foam material is desired because these materials can easily be thermoformed using readily available apparatus. Further, thermoforming methods advantageously allow the disc cross-section to be shaped, as desired, such as into that of disc 101, or whereby a greater concentration of weight could, if desired, be positioned by or define the outer diameter of the disc. Advantageously, shaping the disc cross-section will enable the disc to have more lift and achieve a greater flight.

While many foams are contemplated, in one embodiment, disc 501 is constructed of a closed cell foam, designated as Ensolite, MLC. Ensolite is a trade name of Uniroyal. If desired, such as to enhance lift, to protect the surface, and to provide an attractive medium upon which information can be provided, the exterior surface can be dipped into or coated with a thin, smooth, polyvinyl chloride covering.

Disc 701 comprises flat circular inner and outer plates 702 and 703 which are interconnected by a frusto-conical medial portion 704 wherein the plates 702 and 703 are disposed in separated parallel planes. Inner plate 702 is provided with a circular central opening 706. Disc 701 can be formed of a suitable polyurethane, PVC plastic, or other vinyl plastic. The disc 701 can be vacuum formed, casted, injected molded, or formed by many suitable conventional machines.

FIG. 5 shows discs 601 and 701 secured together, such as by conventional bonding or glues. Openings 706 and 606 are concentric with the diameter of opening 706 being slightly greater than that of opening 606 whereby to define on disc 601 a small compressible annular portion 608 for gripping an element inserted into opening 606 and yielding radially outwardly. Disc 701 functions to reinforce disc 601, but more importantly, provides disc 501 with a central annular cavity or recess 705 whereby to give the lower face 603 of disc 601 the surface contour needed to enhance air flotation and lift. As desired, disc 701 can be secured to either of the surfaces 602 and 603.

In one embodiment, disc 601 has an outer diameter 604 of 9 inches, a central opening 606 of about 2.6 inches, and a thickness from about 0.5 inch to 1.0 inch thick. The hole 607 is about 1 inch and spaced along a radius about 0.75 inches radially inward from the outer periphery. Disc 701 has an outer diameter of about 4.0 inches and an inner diameter of about 3.0 inches.

Figure 6:
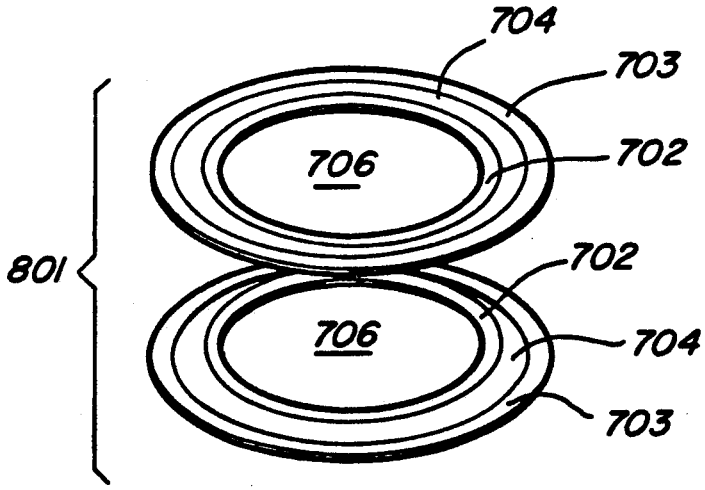
FIGS. 6 and 7, respectively, show assembly of and another preferred embodiment in cross-section of a flying disc in accordance with this invention.
Figure 7:
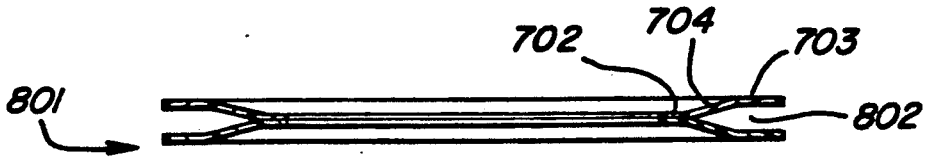
Figure 8A:
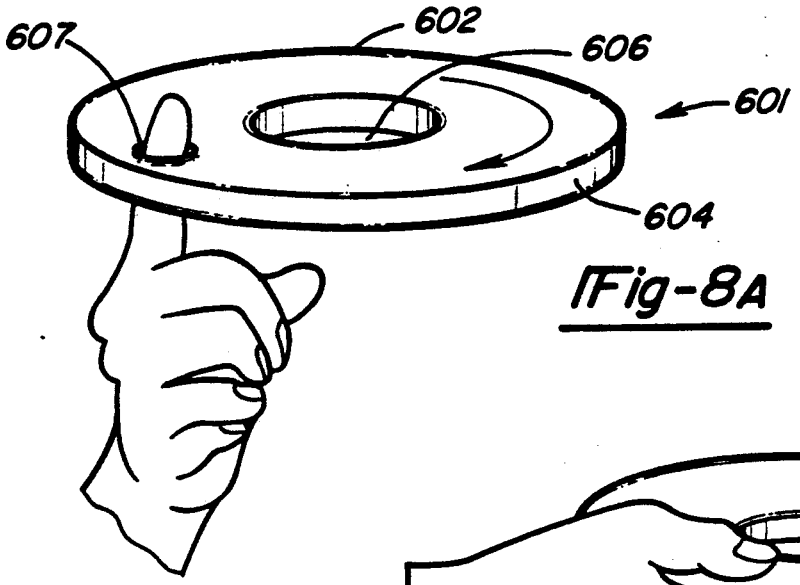
FIGS. 8A, 8B, 8C and 8D are perspective views showing possible uses of the flying discs in accordance with this invention, including, respectively, twirling, spinning, flinging and floating.
Figure 8B:
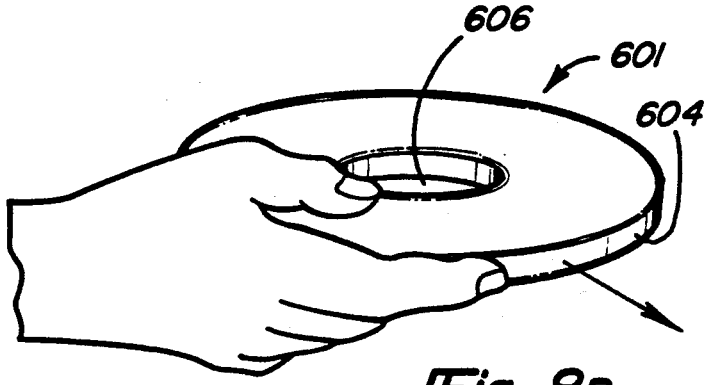
Figure 8C:
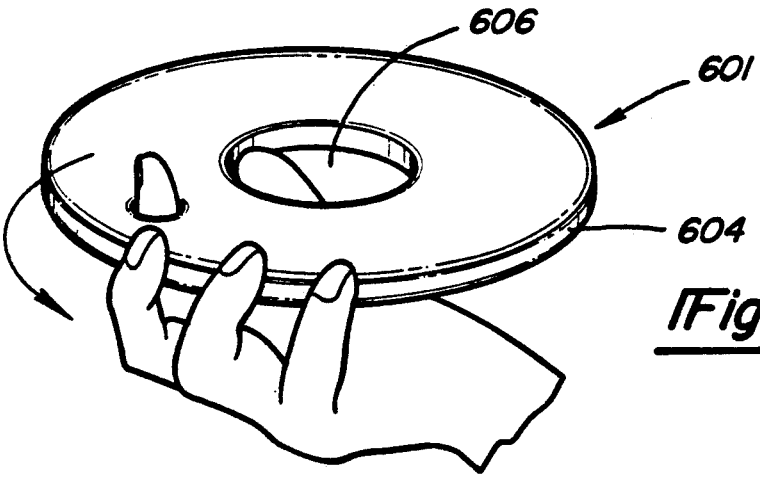
Figure 8D:
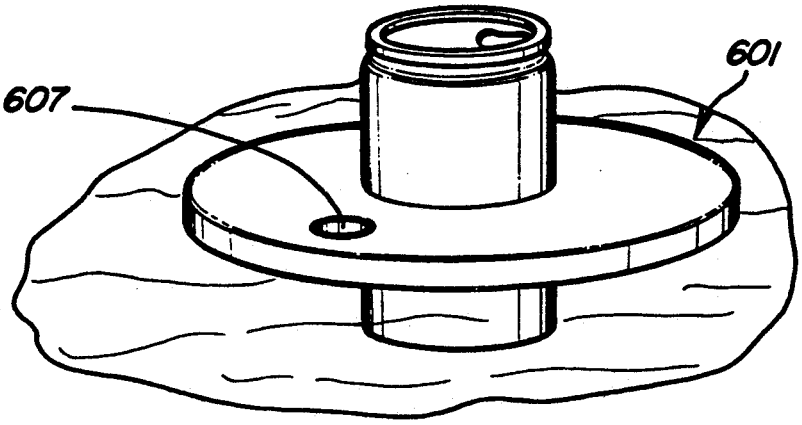

FIGS. 6 and 7 show another preferred embodiment of a tossable disc 801 in accordance with this invention. Disc 801 comprises a pair of discs, such as defined by 701, which are joined together at their radially inward plate portions 702 whereby the outer plates 703 are spaced apart. When plates 702 are bonded together, outer plates 703 form a 360° annular radially outwardly opening slot 802. The joining can be accomplished by many conventional approaches, such as bonding by a glue. Disc 801 gets its air flotation from the inverted curves formed by the inside plates 702.

FIG. 8 shows possible methods of amusement and play, illustrating for the purposes of discussion, flying disc 601. Disc 601 is similar to flying disc 101 both in configuration and use. FIG. 8A illustrates method of play wherein the user's finger is placed in the off-centered hole and disc 601 is spun about the finger. It is to be understood that disc 601 alone could be utilized, without disc 701. FIGS. 8B and 8C illustrate methods of play wherein the user grips the edge of the disc and sends it soaring with a flick of the wrist. FIG. 8D illustrates a use wherein the disc, being constructed of foam, is used to support a beverage can inserted into the central opening. Because the disc is lightweight and of buoyant material, the disc can be used to keep the beverage cool and floating in the pool, near the user.

While the user will undoubtedly find many other uses, another contemplated amusement is in testing coordination by spinning one disc 601 on one index finger in a direction outwardly of the user's body, and then spinning another disc 601 on the other index finger in a direction inwardly of the user's body. The discs would be in a vertical plane (i.e., thumbs facing up). Ultimately, the fingers would be locked.

It is to be understood that the above-detailed description of embodiments of the invention are to be used for illustrative purposes only. Various details of design and construction may be modified without departing from the true spirit and scope of the invention as set forth in the appended claims.

What is claimed is:

1. An amusement device comprising:

a disk adapted for flight, said disk comprising an annular body constructed of a foam-like material and having an upper surface and a bottom surface disposed generally parallel to one another, first means extending between said surfaces and forming a first opening centrally of said disk for releasably gripping an object adapted to be removably retained by said disk, plate means mounted to said bottom surface for strengthening said disk and enhancing lift of the disk when in flight, and second means extending between said surfaces and forming a second opening radially outwardly of said first opening for receiving a finger whereby when a finger is inserted in said second opening said disk can be twirled.

2. The invention as recited in claim 1 wherein said foam-like material consists essentially of a closed-cell foam.

3. The invention as recited in claim 1 wherein said foam-like material is comprises of a soft, lightweight material whereby said disc includes attributes of being buoyant.

4. The invention as recited in claim 1 wherein said upper and bottom surfaces are substantially planar, and said openings are generally circular in shape whereby to define first and second cylindrical walls through said disc.

5. The invention as recited in claim 1 wherein said plate mean is mounted in concentric relation to the first opening for a strengthening said disc.

6. The invention as recited in claim 1 further comprising said disk being thermoformed of a soft foam, and said plate means associated with the disk body forming a central annular cavity to enhance lift of the disk when in flight, said plate means comprising radially inner and outer plate portions and a frusto-conical transition portion interconnecting said plate portions whereby said plate portions are parallel to one another and in vertically spaced planes, said outer plate portion forming at least a portion of said bottom surface, said inner plate portion having a central opening radially inward from and concentric to said outer plate portion, and said transition portion defining at least in part said central annular cavity.

7. The invention as recited in claim 1, wherein said plate means comprises an annular, generally circular plate having an inner plate portion which forms a central opening, an outer plate portion and a frusto-conical plate portion interconnecting said inner and outer plate portions and connecting means for connecting said plate portions to said bottom surface, said inner plate portion being spaced vertically from the plane of said bottom surface whereby to form a central annular vertical cavity to enhance air flotation.

8. The invention as recited in claim 7 wherein said central opening and said first opening are circular and concentric to one another, the diameter of said first opening being less than the diameter of said central opening such that an annular portion of said disk is capable of expanding radially outwardly whereby to form a tight frictional engagement with said object.

9. A tossing ring which is particularly useful as a play toy, comprising an annular body constructed of lightweight, buoyant foam material said annular body including an upper surface and a lower surface defining generally parallel planes, an outer surface and an inner surface defining concentric cylindrical surfaces disposed substantially orthogonally to said planes, means defining a hole extending between said upper and lower surfaces sized for receiving the index finger whereby the disk can be twirled about said finger, and plate means secured to the lower surface and defining a vertical cavity for enhancing lift and rigidifying said disk.

10. The invention as recited in claim 9 wherein said plate means comprises a plate having first and second concentric plate portion, said first plate portion defining a radially outer portion of said disk and said second plate portion being vertically spaced from said radially outer portion to define at least in part a central cavity.

11. A tossable ring comprising first and second circular rings, each ring having an annular first portion spaced radially from an annular second portion, said first and second annular portions being generally flat and spaced in different planes, and means connecting said first portions together, the first portions being coplanar and cooperating to define a central opening.

* * * * *